US007046196B1

(12) United States Patent
Langley et al.

(10) Patent No.: US 7,046,196 B1
(45) Date of Patent: May 16, 2006

(54) DUAL-BAND MICROSTRIP ANTENNA

(75) Inventors: Richard Jonathan Langley, Canterbury (GB); Didier Viratelle, Peris (FR)

(73) Assignee: Harada Industry Co., Ltd., Tokyo (JP)

( * ) Notice: Subject to any disclaimer, the term of this patent is extended or adjusted under 35 U.S.C. 154(b) by 162 days.

(21) Appl. No.: 10/089,532

(22) PCT Filed: Sep. 29, 2000

(86) PCT No.: PCT/GB00/03746

§ 371 (c)(1),
(2), (4) Date: Oct. 21, 2002

(87) PCT Pub. No.: WO01/24314

PCT Pub. Date: Apr. 5, 2001

(30) Foreign Application Priority Data

Sep. 30, 1999 (GB) ..... 9923174

(51) Int. Cl.
*H01Q 1/38* (2006.01)
*H01Q 1/24* (2006.01)

(52) U.S. Cl. ..... 343/700 MS; 343/702

(58) Field of Classification Search ..... 343/700 MS, 343/702, 846

See application file for complete search history.

(56) References Cited

U.S. PATENT DOCUMENTS 4,060,810 A 11/1977 Kerr et al. ..... 343/700 MS
4,771,291 A 9/1988 Lo et al. ..... 343/700 MS
5,001,493 A * 3/1991 Patin et al. ..... 343/700 MS
5,365,246 A 11/1994 Rasinger et al. ..... 343/702
5,926,139 A 7/1999 Korisch ..... 343/702

FOREIGN PATENT DOCUMENTS

| | | |
|---|---|---|
| EP | 0 777 295 A2 | 6/1997 |
| JP | 9162635 | 6/1997 |
| WO | WO 98/44587 | 10/1998 |
| WO | WO 98/44588 | 10/1998 |
| WO | WO99/28990 | 6/1999 |

OTHER PUBLICATIONS

Cho et al., Improved Analysis Method for Broadband Rectangular Microstrip Antenna Geometry Using E-Plane Gap Coupling, Electronics Letters Oct. 20, 1993, vol. 29, No. 22, pp. 1907-1909.

* cited by examiner

*Primary Examiner*—Michael C. Wimer
(74) *Attorney, Agent, or Firm*—Dickstein, Shapiro, Morin & Oshinsky, LLP.

(57) ABSTRACT

A dual-band microstrip antenna has a ground plate and also has a central patch positioned between a pair of side patches. The antenna has a single signal feedline, connected to the central patch, and the side patches are shorted to the ground element. Conductive surfaces of the ground plate and patches that carry surface current from signal radiation are contoured such that only portions of conductive surfaces that carry more than a negligible amount of the surface current are retained. The antenna has a reduced weight and improved bandwidth over conventional antennas that operate in the 925 MHz and 1800 MHz ranges.

17 Claims, 9 Drawing Sheets

MEASURED RADIATION PATTERNS IN YZ PLANE

- - - - - F = 925 MHz :COPOLARIZATION

——— F = 1.8 GHz :COPOLARIZATION

MEASURED RADIATION PATTERNS IN XZ PLANE

- - - - - 925 MHz COPOLARIZATION

——— 1.8 GHz COPOLARIZATION

DUAL-BAND MICROSTRIP ANTENNA

The invention relates to a dual-band antenna, and provides a dual-band microstrip antenna that has ground and patch elements configured such that the contour of the surface areas of the elements substantially corresponds to the pattern of induction currents created in the elements by signals in the dual bands.

One important use of dual-band microstrip antennas is in mobile communication systems. A common configuration for an antenna in such use is the inverted-F geometry which is described in two articles by Zi Dong Liu and Peter S. Hall. The first article is "Dual-band antenna for hand held portable telephones", Electronics Letters, Vol. 32, No. 7, pp. 609–610 (March 1996), and the second (and more comprehensive) is "Dual-Frequency Planar Inverted-F Antenna", IEEE Transactions on Antennas and Propagation, Vol. 45, pp. 1451–1457 (October 1997).

Liu and Hall describe two dual-frequency-band antenna configurations, one with a single input port and the other with two input ports. The two-port antenna consists of two co-planar radiating elements—the first one being rectangular and the second one being L-shaped and having two sides adjacent the first one. The rectangular element is for 1.8 GHz signals, while the L-shaped element is for 0.9 GHz signals. This configuration of dual-band antenna is about the same size as a single-band inverted-F antenna for 0.9 GHz signals. Both the rectangular element and the L-shaped element have one end shorted to the ground plane. Because the two radiating elements are not connected, the coupling between the two antennas is small and only due to fringe-field interaction. A variation has a single input port connected to an intermediate point of connection between the rectangular element and the L-shaped element. Although it has the advantage of using only a single input port, this arrangement has the drawback that the coupling between the rectangular element and the L-shaped element is increased.

As with the variation of the dual-frequency-band antenna of Lui and Hall, the antenna of the subject invention utilizes multiple radiating elements with a single input port; unlike the antenna of Lui and Hall, however, the multiple radiating elements of the subject antenna are not connected. The antenna of the subject invention has the advantages over that of Lui and Hall of having only two shorting points and a much-increased bandwith. In addition, portions of the radiating and ground elements that carry little or no surface current are removed, resulting in weight reduction and a degree of transparency. A further advantage is that the dual-band antenna of the invention is capable of being mass-produced at low cost using flexible printed circuit board.

U.S. Pat. No. 5,365,246 (Siemens Aktiengesellschaft) discloses a transmitting and/or receiving arrangement for portable appliances. In one embodiment (FIG. 5), three sheet-metal angles 2, 9 and 3 extend from a connected shielding housing 1, and a signal feedline 4 connects with the central one of the angles (angle 9). This arrangement differs from the subject invention, in which the central patch is not connected to ground.

An article by Y. K. Cho et al., entitled "Improved Analysis Method for Broadband Rectangular Microstrip Antenna Geometry Using E-plane Gap Coupling", Electronic Letters, Vol. 29, No. 22 (28 Oct. 1993), discloses an antenna having a ground member and capacitively-coupled short-circuited parasitic outer patches at the radiating edges of a central patch, as shown in FIG. 3 of that article. This reference refers to analysis of coupling slots used to improve bandwidth of microstrip antennas. This antenna operates in only a single band, and the coupling is used to improve bandwidth of that band. Each outer patch is short-circuited to ground along the full length of one-side edge, which is opposite the other side edge that abuts the central patch. This differs from the subject invention in which the the pair of outer patches are each shorted to ground through one end.

In one form, the invention is a dual-band microstrip antenna that includes a ground member and also includes a patch means having discrete first and second portions which are generally parallel to each other and spaced apart from the ground member. The patch means and the ground member are configured such that the antenna exhibits first and second resonant frequency ranges by electromagnetic interaction between the patch means and the ground member when the antenna is active. Conduction surfaces of the portions of the patch means are shaped to substantially correspond to patterns of current flow detected in the conduction surfaces when the antenna is active before such shaping. Conduction surfaces of the ground member may be shaped in a similar manner.

In the antenna, sides and one end of the patch means may be in respective alignment with sides and one end of the ground member. The first portion of the patch means may be a first patch, and the second portion of the patch means may be a pair of second patches each having a side adjacent a respective opposite side of the first patch. One end of each first and second patch corresponds to the one end of the patch means. An antenna signal feedline is connected to a generally central position on the first patch. The first patch is not directly connected to the ground member, and a shorting member extends from each second patch to the ground member at a point proximate the one end of the second patch and the ground member.

Each second patch may have a length approximating the length of the first patch, and a width approximating one-half the width of the first patch. The first patch may be generally configured as an 'H', with the sides of the first patch corresponding to side members of the 'H'.

In a first construction, the conduction surfaces of the ground member may be configured as a hollow generally rectangular structure, with a cross-piece extending between the sides of the structure at a projection of the position at which the antenna signal feedline connects to the first patch. In a second construction, the conduction surfaces of the ground member may be defined by two side members and an other-end member and with a cross-piece extending between the two side members at a projection of the position at which the antenna signal feedline connects to the first patch. In the second construction, extensions of the side members of the first patch extend from the one end of the patch means to the plane of the ground member and then in the plane of the ground member for a part of the distance toward the cross-piece.

A coaxial cable may be attached to the antenna such that a ground portion of the cable is connected to the cross-piece of the ground member, and such that a signal feed portion of the cable defines the antenna signal feedline attached to the first patch.

The antenna may be formed from printed circuit board having a conductive layer on one side. The conducting surfaces of the ground member are formed by removing portions of a conductive layer on the one side of a first segment of the circuit board. The conducting surfaces of the patch means are formed by removing portions of the conductive layer on the one side of a second segment of the board. The first and second segments of the circuit board are then mounted in parallel spaced relationship. In the first construction, shorting members are applied between the ground member and the second patches proximate the one end of the ground member and the second patches, whereas in the second construction, shorting members are applied between the one end of the ground member and the one end of the first and second patches.

In another form, the invention is a dual-band microstrip antenna that includes a ground member and first and second portions of a patch means. The patch means is in a generally parallel spaced relationship with the ground member. First and second resonant frequency ranges are defined by the electromagnetic interaction between the patch means and the ground member. Sides and one end of the patch means are in respective alignment with sides and one end of the ground member. The first portion of the patch means is a first patch, and the second portion of the patch means is a pair of second patches each positioned adjacent a respective opposite side of the first patch. One end of each first and second patch corresponds to one end of the patch means. An antenna signal feedline is connected to a generally central position on the first patch, and a shorting member extends from each second patch to the ground member at a point proximate the one end of the second patch and the ground member.

The invention will next be more fully described by way of example only, by means of preferred embodiments, utilizing the accompanying drawings, in which.

Figure 1:
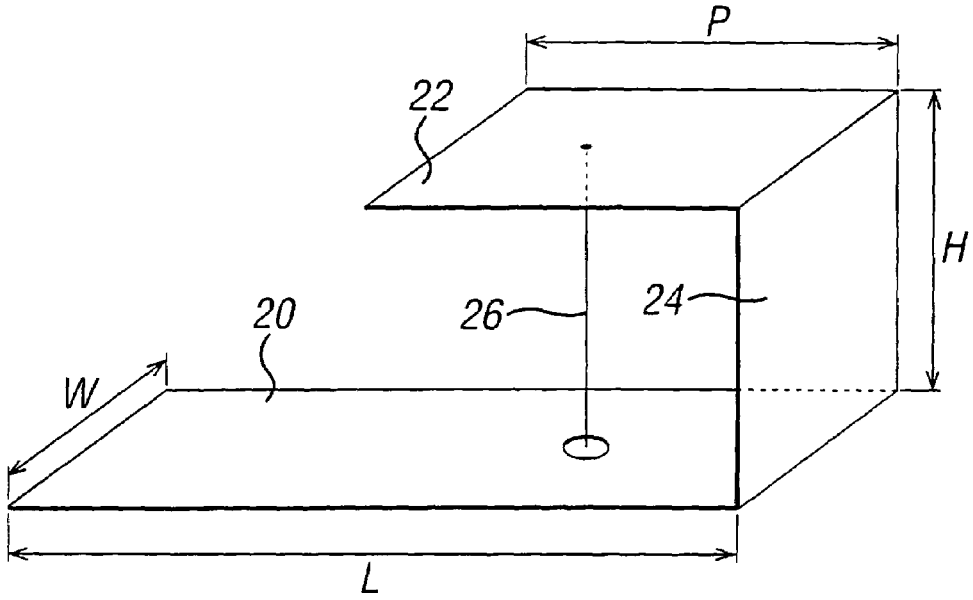
FIG. 1 is a perspective view of a typical prior art inverted-F antenna adapted to operate over a single frequency band.

Referring first to FIG. 1, the typical prior art inverted-F antenna operating on a single frequency band has a ground plate 20 of length L that is connected to a patch plate 22 of length P through a shorting plate 24 of height H; the three plates 20, 22 and 24 all have a width W. A feed pin 26, which is an extension of the centre wire of a coaxial cable (not shown) that has its ground wire connected to ground plate 20, connects to a central position on the patch plate 22. The length P of patch plate 22 approximates one-quarter wavelength at the mid-range of the frequency band of the antenna. The metallic surface of ground plate 20 may be provided by the metallic side of a portable telephone or other device on which the antenna is used.

Figure 2:
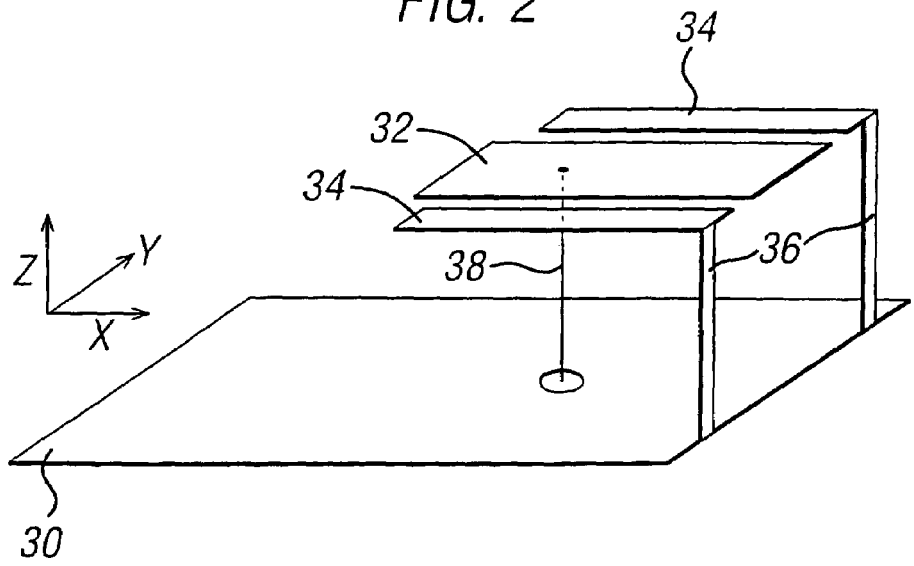
FIG. 2 is a perspective view of an embodiment of the dual-band microstrip antenna of the invention.

Prior to removal of metal from the ground plate and the radiating patches, an embodiment of the dual-band microstrip antenna has, as shown in FIG. 2, a ground plate 30, a central patch plate 32, a pair of side patch plates 34, and a pair of shorting strips 36 each of which connects a respective side patch plate 34 to the ground plate 30. A feed pin 38, which as with feed pin 26 in FIG. 1 is an extension of the centre wire of a coaxial cable (not shown), connects to a central position on the central patch plate 32; a ground wire of the coaxial cable is connected to the ground plate 30. The connection point of feed pin 38 and the lengths of patch plates 32 and 34 are experimentally adjusted until the desired antenna bandwidths and a 50-ohm impedance match with the coaxial cable are obtained. As shown, the side patch plates 34 are each narrower and slightly shorter than the central patch plate 32. FIG. 2 illustrates the orientation of the antenna with respect to a X-Y-Z co-ordinate system that has application to the radiation patterns shown in FIGS. 11 and 12.

Figure 3:
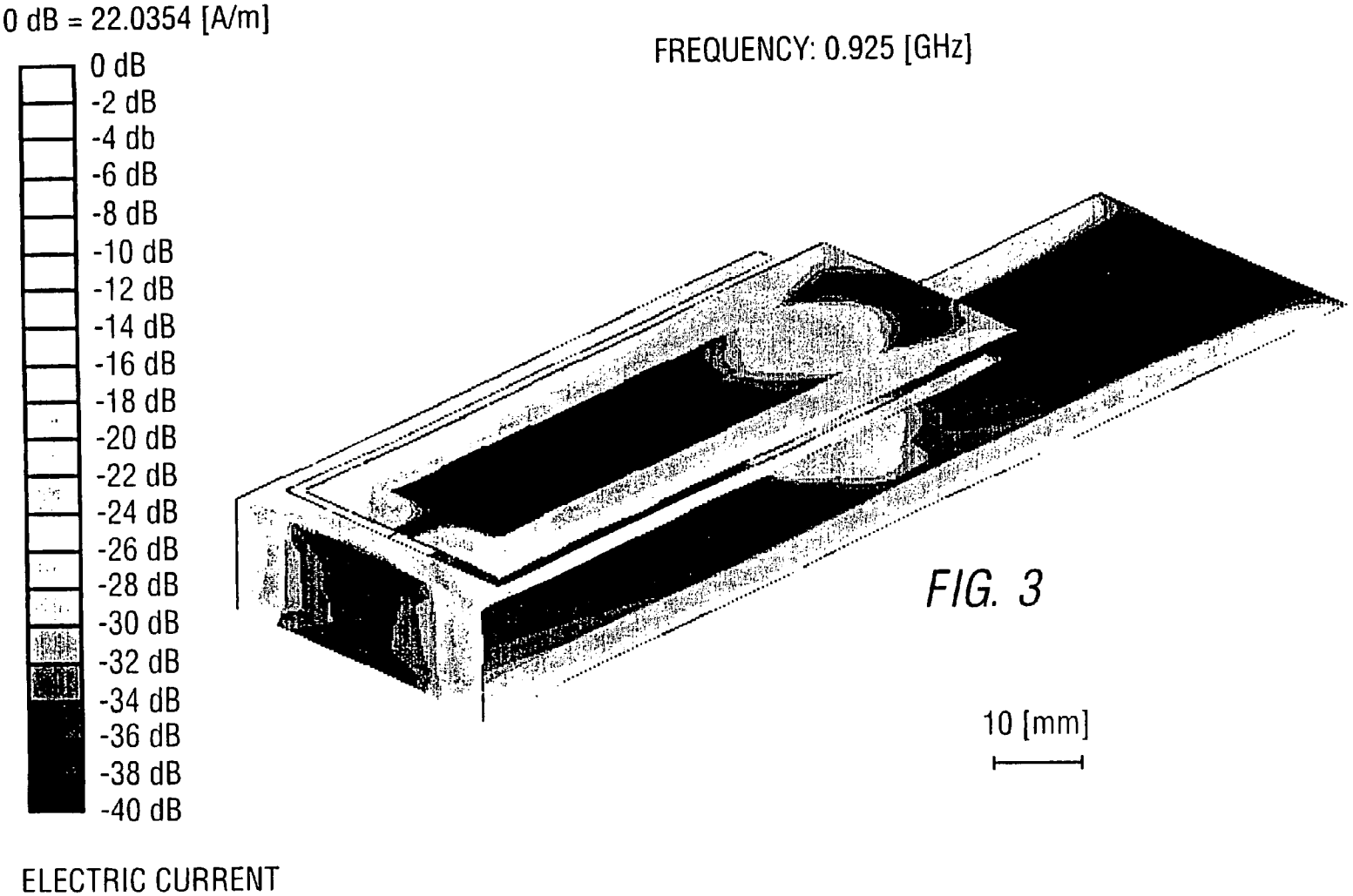
FIG. 3 is an illustration of the surface currents on the antenna of FIG. 2 at a radiating frequency of 925 Megahertz.
Figure 4:
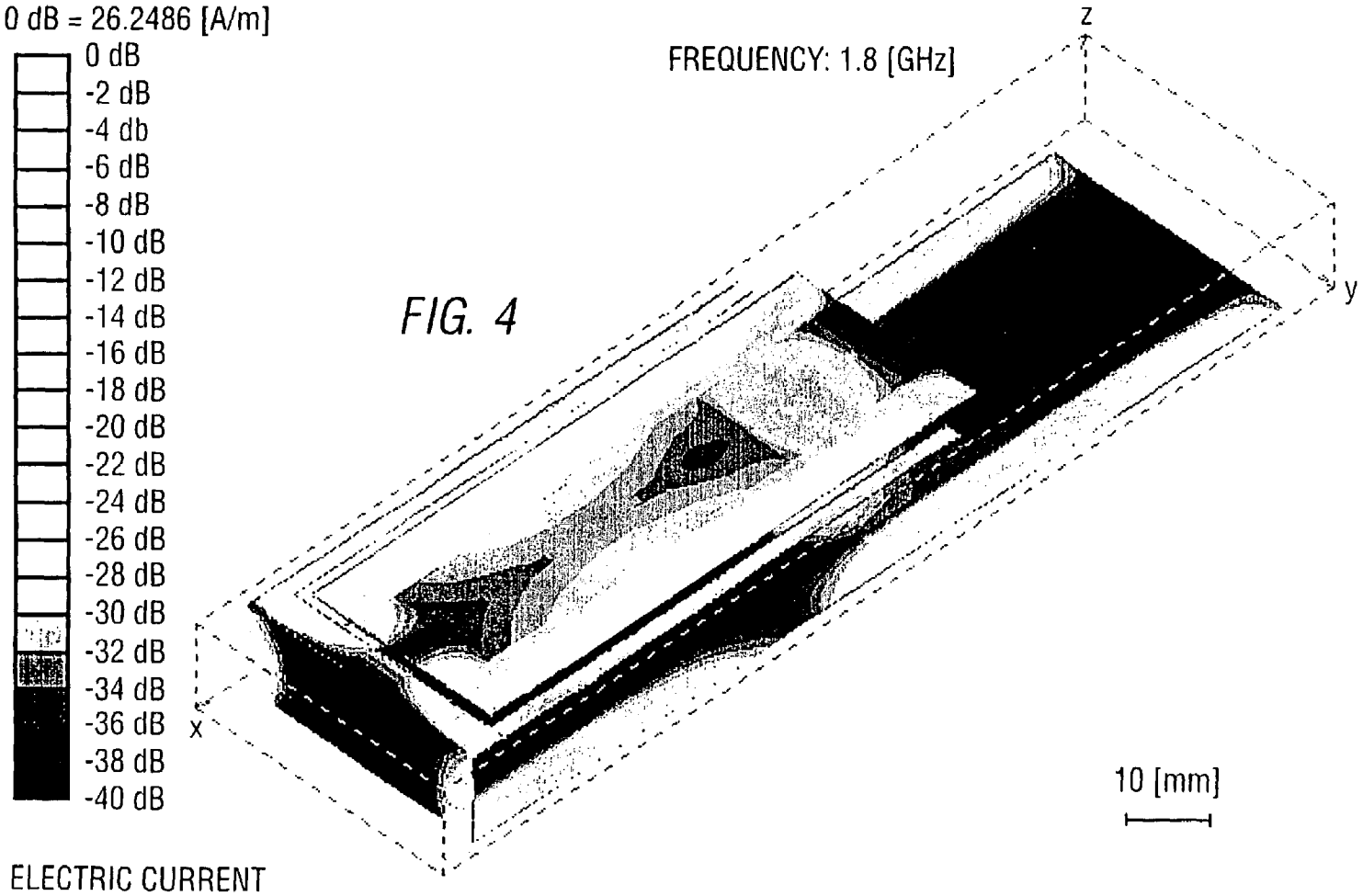
FIG. 4 is an illustration of the surface currents on the antenna of FIG. 2 at a radiating frequency of 1800 Megahertz.

When the surface currents on conductive material of the antenna of FIG. 2 were measured in the frequency ranges of 925 MHz (FIG. 3) and 1800 MHz (FIG. 4), it was found that little or no surface current was present on large areas of the conductive material at either frequency range. Those areas of the conductive material therefore contribute to the weight but not to the performance of the antenna, and may be removed. Removal of that material has also been found to improve the bandwidth.

Figure 5:
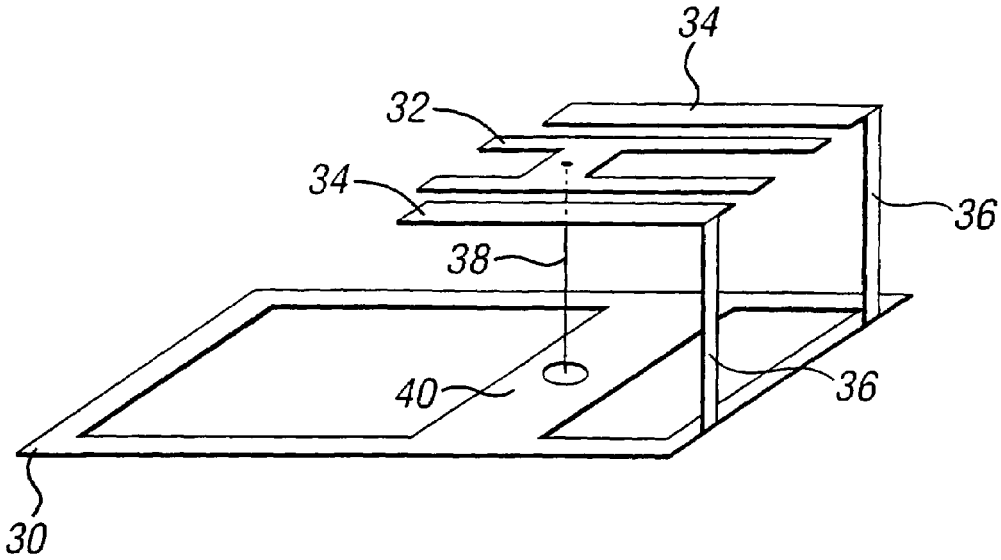
FIG. 5 is a perspective view of another embodiment of the microstrip antenna of the invention, the antenna being similar to FIG. 2 but having excess metal removed from the ground plate and the patch plates.

FIG. 5 illustrates the antenna of FIG. 2 after removal of the conductive material that was found to carry little or no surface current in the two frequency bands of interest. A central portion of ground plate 30 has been removed except for a cross-piece 40 to which a signal carrier, such as a coaxial cable, is connected. Two central sections of the central patch plate 32 have also been removed—giving the central patch plate 32 an 'H' configuration.

Figure 6:
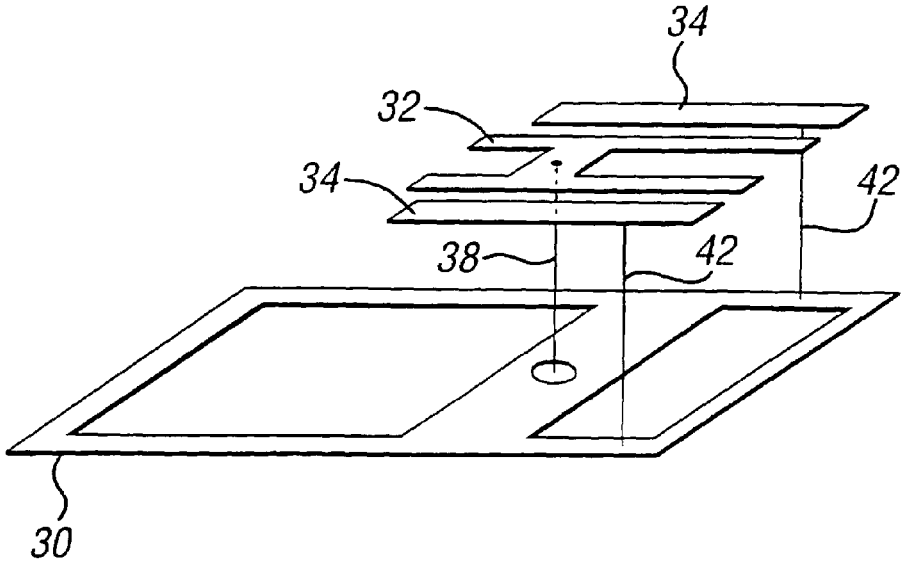
FIG. 6 is a further embodiment of the microstrip antenna of the invention, the antenna being a slightly-modified version of the antenna of FIG. 5.
Figure 7:
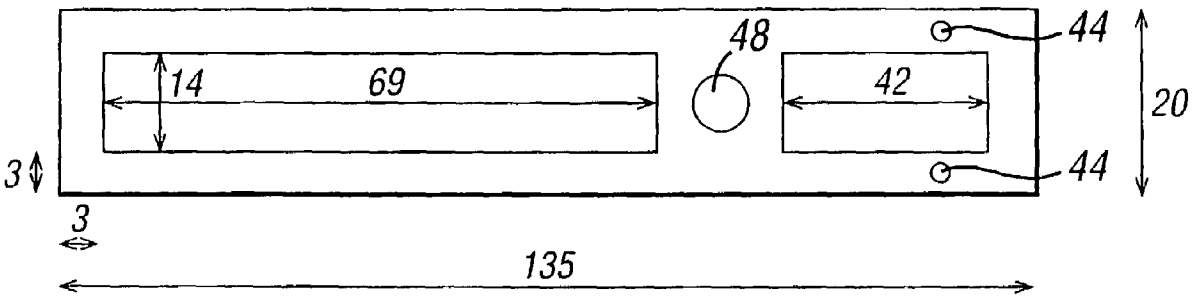
FIG. 7 is a top view of a ground plate of the further embodiment of the antenna of the invention.
Figure 8:
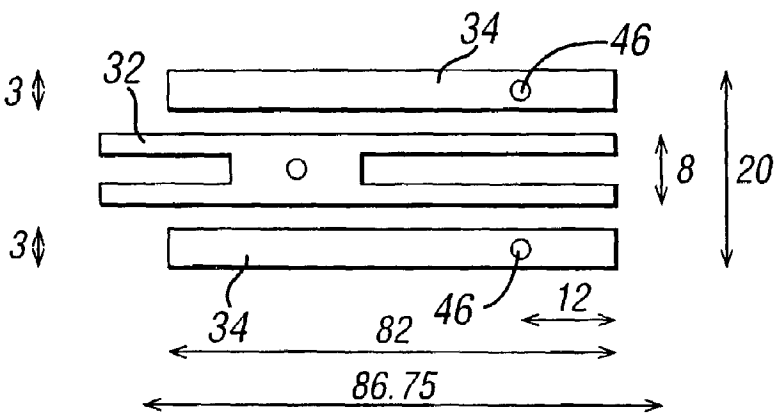
FIG. 8 is a top view of the patches of the further embodiment of the antenna of the invention.

The embodiment of the antenna in FIG. 6 differs from the one shown in FIG. 5 in the type and placement of the shorting means; except for the shorting means, the numbering of parts in both is the same. The shorting means differs between the embodiments of FIGS. 5 and 6 in that each shorting pin 42 in the FIG. 6 embodiment is not connected between the end of the ground plate 30 and the end of a respective side patch plate 34, but instead is connected at positions removed from the ends. Each shorting pin 42 extends (as shown in FIGS. 7 and 8) between a hole 44 on ground plate 30 and a hole 46 on a respective side patch plate 34. The signal feed pin 38 extends through the large hole 48 in cross-piece 40. A top view of the ground conducting plate is shown in FIG. 7, and a top view of the patch plates is shown in FIG. 8. A side or cross view of the antenna of FIG. 6 is shown in FIG. 9, in which a connector 50 for connecting a coaxial cable or other signal carrier to the ground plate 30 is shown.

Figure 9:
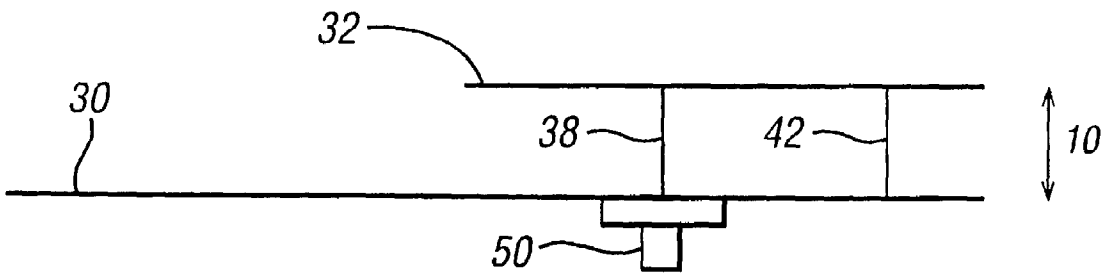
FIG. 9 is a side or cross view of the further embodiment of the microstrip antenna of the invention.

The numbers adjacent the arrows in FIGS. 7 to 9 represent in millimeters the dimensions of the ground plate 30 and the patch plates 32, 34 in the antenna of this preferred embodiment—as well as their relative spacing. The ground plate is 13.5 cm. long and 20 cm. wide, the central patch plate 32 is 86.75 mm. long and 8 mm. wide, and the side patch plates 34 are each 82 mm. long and 3 mm. wide. The width of the spacing between the central patch plate 32 and each side patch plate 34 is 2 mm. Each of the holes 44 and 46, to which the shorting pins 42 connect, is 12 mm. from the end of the respective ground plate 30 and side patch plate 34.

Figure 10:
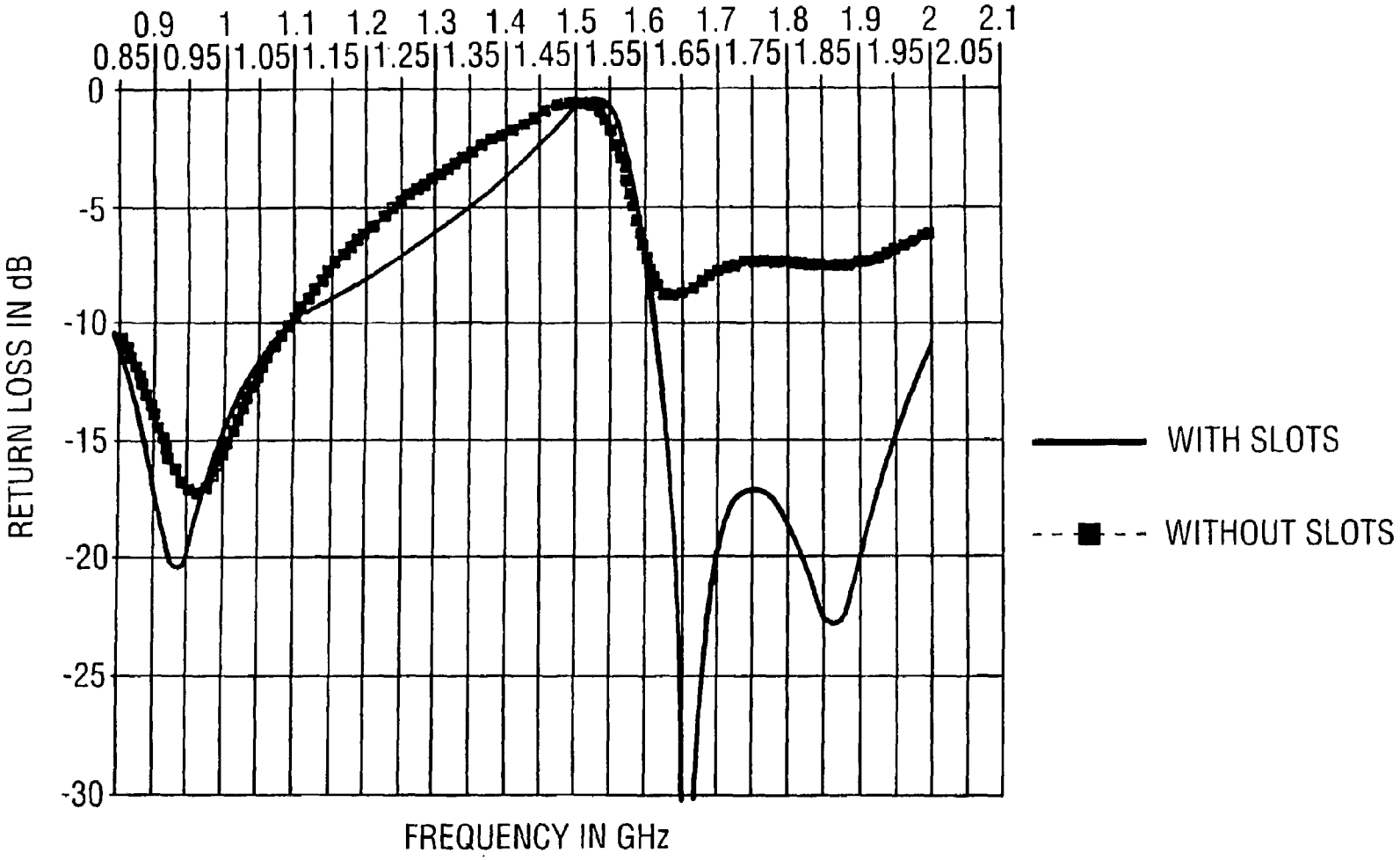
FIG. 10 is a graph illustrating the return loss for the antennas shown in FIGS. 2 and 5.
Figure 11:
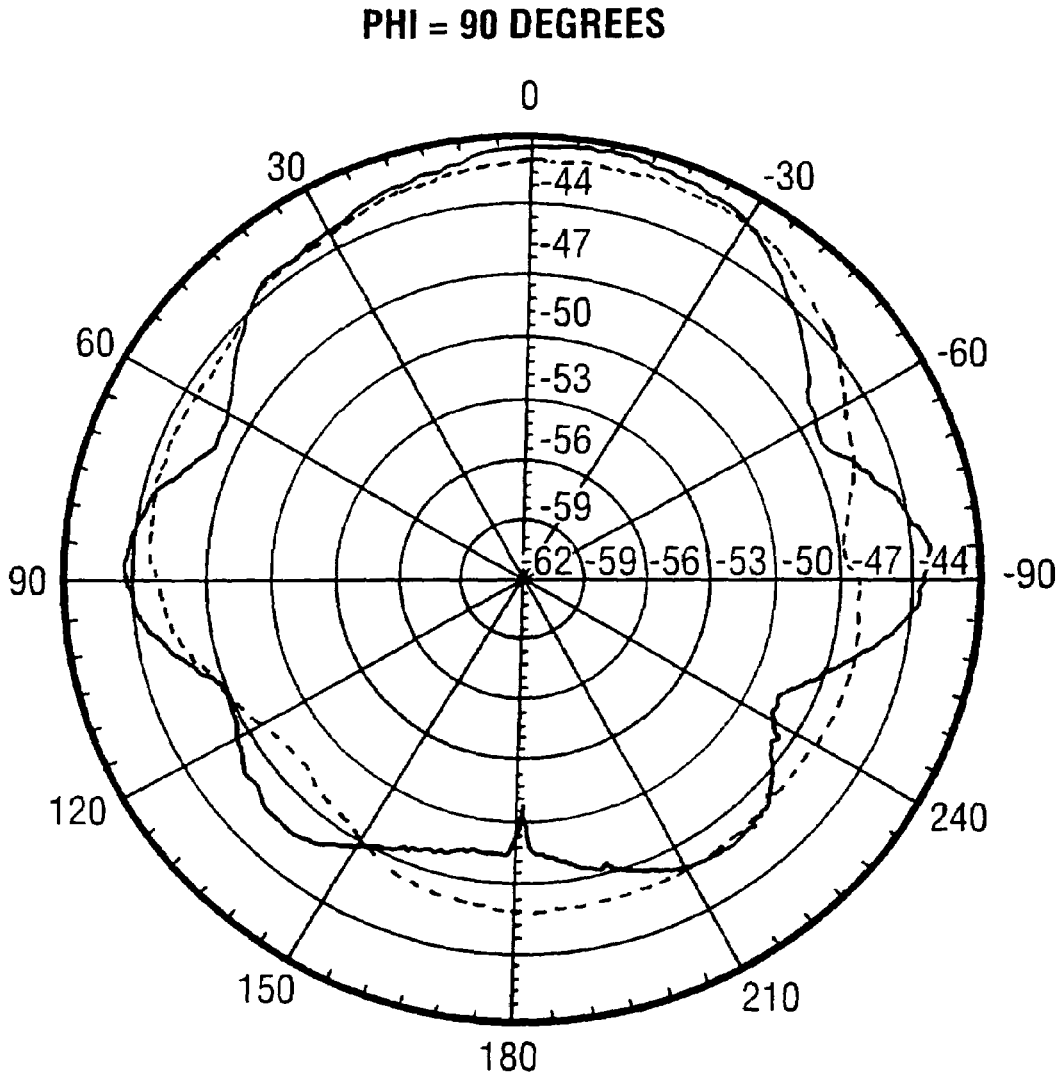
FIG. 11 is an illustration of the radiation patterns obtained in the YZ plane (based on the axes orientation shown in FIG. 2) for the antenna of the embodiment shown in FIGS. 6 to 9, measured at 925 MHz and 1800 MHz.
Figure 12:
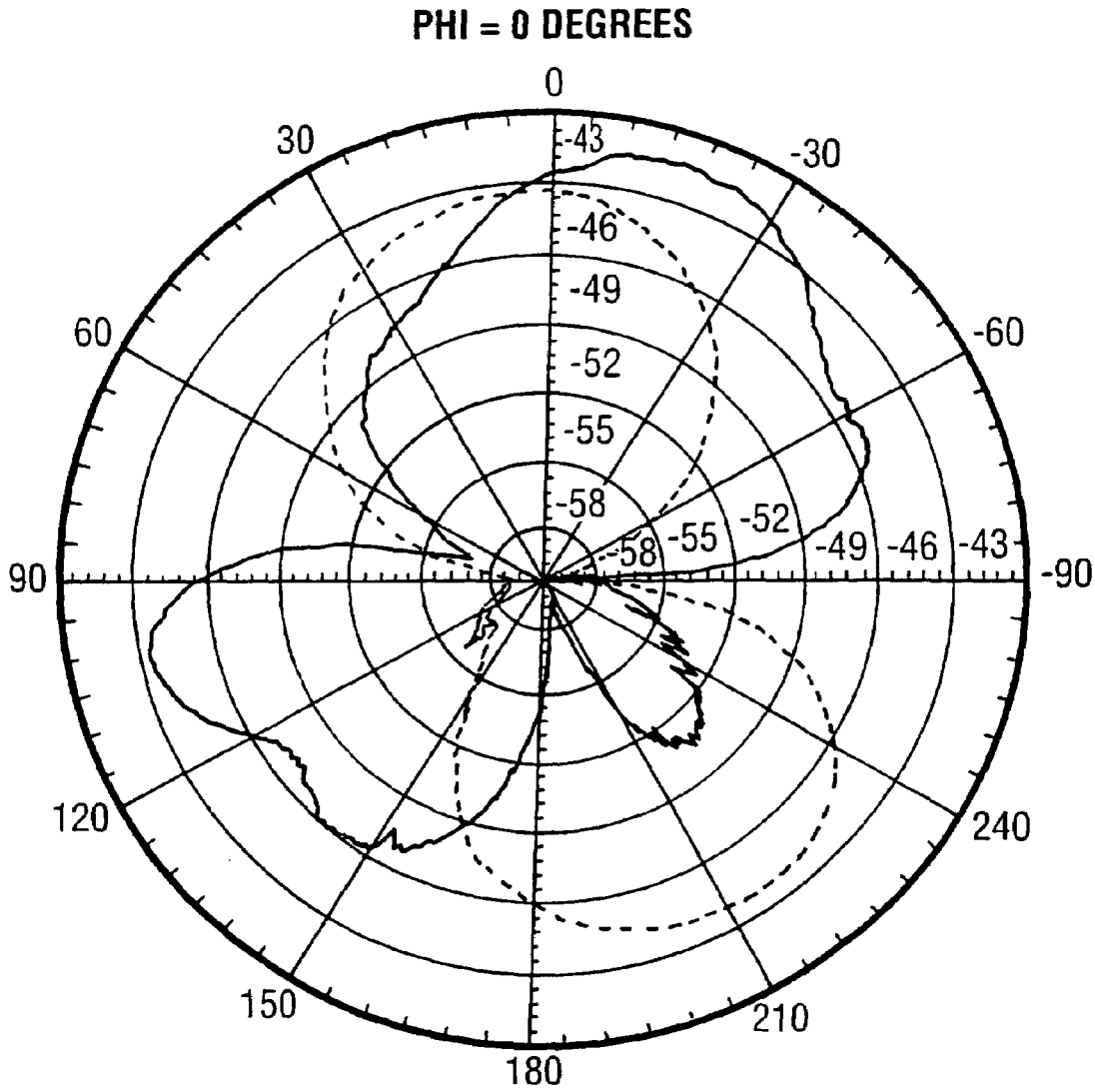
FIG. 12 is an illustration of the radiation patterns obtained in the XZ plane (based on the direction of axes shown in FIG. 2) for the antenna of the embodiment shown in FIGS. 6 to 9, measured at 925 MHz and 1800 MHz; and, FIG. 13 is an illustration of a further embodiment of the dual-band antenna of the invention, that antenna having a wrap-around first patch.

FIG. 10 illustrates the difference in return loss between the antennas of FIGS. 2 and 5. At the two resonant frequencies, the return loss can be seen to be greater in the antenna with metal removed (solid line) than in the antenna without metal removed (dotted line). Measured radiation patterns in the YZ and XZ planes (with reference to the co-ordinate system in FIG. 2) for the antenna embodiment of FIGS. 6 to 9 are shown in FIGS. 11 and 12, respectively.

Figure 13:
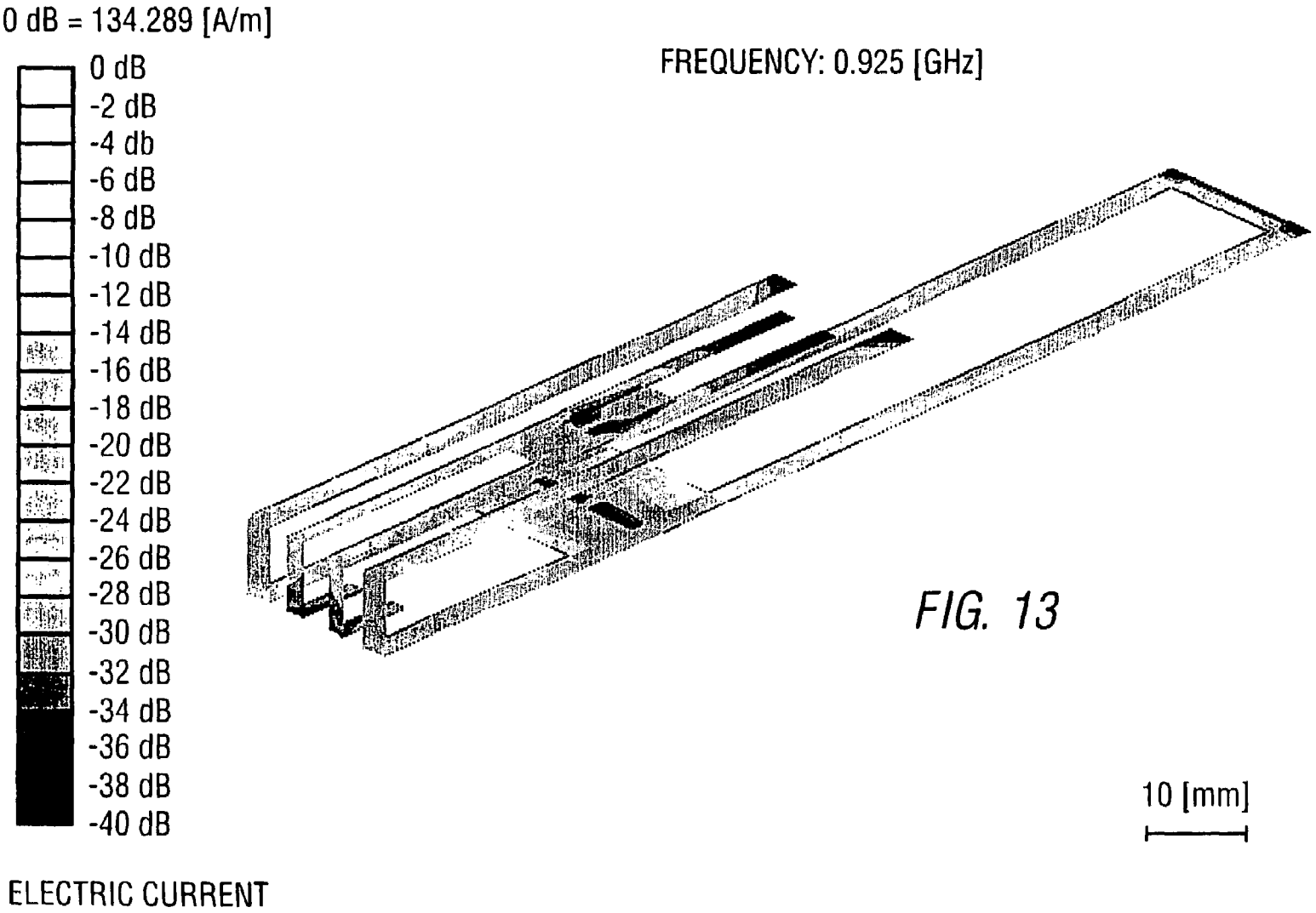

FIG. 13 illustrates a further preferred embodiment of the antenna of the invention. It differs from the embodiment shown in FIGS. 6 to 9 in that the central patch plate 32 has a wrap-around configuration in which one end of a hollow ground plate 30 has been removed, and the sides of the central patch plate 32 have been extended across to the plane of the ground plate 30 and then a part of the distance toward the cross-piece 40 in that plane.

A dual-band microstrip antenna has a ground plate and also has a central patch positioned between a pair of side patches. The antenna has a single signal feedline, connected to the central patch, and the side patches are shorted to the ground element. Conductive surfaces of the ground plate and patches that carry surface current from signal radiation are contoured such that only portions of conductive surfaces that carry more than a negligible amount of the surface current are retained. The antenna has a reduced weight and improved bandwidth over conventional antennas that operate in the 925 MHz and 1800 MHz ranges.

The invention claimed is:

1. A dual-band microstrip antenna comprising:

a ground member; and first and second portions of a patch structure that is in a generally parallel spaced relationship with the ground member, first and second resonant frequency ranges being defined by electromagnetic interaction between the patch structure and the ground member; wherein sides and one end of the patch structure are in respective alignment with sides and one end of the ground member, wherein the first portion of the patch structure is a first patch and the second portion of the patch structure is a pair of second patches, each second patch having a side adjacent a respective opposite side of the first patch, one end of each first and second patch corresponding to the one end of the patch structure, wherein an antenna signal feedline is connected to a generally central position on the first patch, wherein the first patch is not directly connected to the ground member, and wherein a shorting member extends from each second patch to the ground member at a point proximate the one end of the second patch and the ground member.

2. A dual-band microstrip antenna as in claim 1, wherein conduction surfaces of the ground member are shaped to substantially correspond to patterns of current flow detected in the ground-member conduction surfaces when the antenna is active before such shaping.

3. A dual-band microstrip antenna as in claim 1, wherein the ground member has a rectangular outer profile and wherein sides and one end of the patch structure are in respective alignment with sides and one end of the ground member.

4. A dual-band microstrip antenna as in claim 1, wherein each second patch has a length approximating the length of the first patch, and has a width approximating one-half the width of the first patch.

5. A dual-band microstrip antenna as in claim 4, wherein the first patch is generally configured as an 'H' with the sides of the first patch corresponding to side members of the 'H'.

6. A dual-band microstrip antenna as in claim 5, wherein a conduction surface of the ground member is defined by two side members and an other end member and with a cross-piece extending between the two side members at a projection of the position at which the antenna signal feedline is connectable to the first patch, and wherein extensions of the side members of the first patch extend from the one end of the patch structure to the plane of the ground member and then in the plane of the ground member for a part of the distance toward the cross-piece.

7. A dual-band microstrip antenna as in claim 6, wherein a coaxial cable is attached to the antenna such that a ground portion of the cable is connected to the cross-piece of the ground member, and such that a signal feed portion of the cable defines the antenna signal feedline attached to the first patch.

8. A dual-band microstrip antenna as in claim 6, wherein the antenna is formed from one or more printed circuit boards having a conductive layer on one side, wherein the conduction surfaces of the ground member are formed by removing portions of the conductive layer on the one side of a first segment of the circuit board, wherein the conduction surfaces of the patch structure are formed by removing portions of the conductive layer on the one side of a second segment of the circuit board, wherein the first and second segments of the circuit board are then mounted in parallel spaced relationship, and wherein shorting members are applied between the one end of the ground member and the one end of the first and second patches.

9. A dual-band microstrip antenna comprising;

a ground member; and a patch structure having discrete first and second portions that are generally parallel to each other and spaced apart from the ground member, the patch structure and the ground member being configured such that the antenna exhibits first and second resonant frequency ranges by electromagnetic interaction between the patch structure and the ground member when the antenna is active;

wherein conduction surfaces of the portions of the patch structure are shaped to substantially correspond to patterns of current flow detected in the conduction surfaces when the antenna is active before such shaping; wherein the ground member has a rectangular outer profile; wherein sides and one end of the patch structure are in respective alignment with sides and one end of the ground member; wherein the first portion of the patch structure is a first patch, wherein the second portion of the patch structure is a pair of second patches each positioned adjacent a respective opposite side of the first patch, one end of each first and second patch corresponding to the one end of the patch structure, wherein an antenna signal feedline is connected to a generally central position on the first patch, and wherein a shorting member extends from each second patch to the ground member at a point proximate the one end of the second patch and the ground member, wherein the electromagnetic interaction between the patch structure and the ground member is electromagnetic interaction between the first patch and the ground member and between the first patch and the pair of second patches, wherein each second patch has a length approximating the length of the first patch, and has a width approximating one-half the width of the first patch, and wherein the first patch is generally configured as an 'H', with the sides of the first patch corresponding to side members of the 'H'.

10. A dual-band microstrip antenna as in claim 9, wherein a conduction surface of the ground member is defined by two side members and an other-end member and with a cross-piece extending between the two side members at a projection of the position at which the antenna signal feedline is connectable to the first patch, and wherein extensions of the side members of the first patch extend from the one end of the patch structure to the plane of the ground member and then in the plane of the ground member for a part of the distance toward the cross-piece.

11. A dual-band microstrip antenna as in claim 10, wherein a coaxial cable is attached to the antenna such that a ground portion of the cable is connected to the cross-piece of the ground member, and such that a signal feed portion of the cable defines the antenna signal feedline attached to the first patch.

12. A dual-band microstrip antenna as in claim 10, wherein the antenna is formed from a printed circuit board having a conductive layer on one side, wherein the conduction surfaces of the ground member are formed by removing portions of the conductive layer on the one side of a first segment of the circuit board, wherein the conduction surfaces of the patch structure are formed by removing portions of the conductive layer on the one side of a second segment of the circuit board, wherein the first and second segments of the circuit board are then mounted in parallel spaced relationship, and wherein shorting members are applied between the ground member and the second patches proximate the one end of the ground member and the one end of the first and second patches.

13. A dual-band microstrip antenna comprising;

a ground member; and a patch structure having discrete first and second portions that are generally parallel to each other and spaced apart from the ground member, the patch structure and the ground member being configured such that the antenna exhibits first and second resonant frequency ranges by electromagnetic interaction between the patch structure and the ground member when the antenna is active;

wherein conduction surfaces of the portions of the patch structure are shaped to substantially correspond to patterns of current flow detected in the conduction surfaces when the antenna is active before such shaping; wherein the ground member has a rectangular outer profile; wherein sides and one end of the patch structure are in respective alignment with sides and one end of the ground member; wherein the first portion of the patch structure is a first patch, wherein the second portion of the patch structure is a pair of second patches each positioned adjacent a respective opposite side of the first patch, one end of each first and second patch corresponding to the one end of the patch structure, wherein an antenna sigal feedline is connected to a generally central position on the first patch, wherein a shorting member extends from each second patch to the ground member at a point proximate the one end of the second patch and the ground member, wherein the electromagnetic interaction between the patch structure and the ground member is electromagnetic interaction between the first patch and the ground member and between the first patch and the pair of second patches, and wherein a conduction surface of the ground member is configured as a hollow generally rectangular structure, with a cross-piece extending between the sides of the structure at a projection of the position at which the antenna signal feedline is connectable to the first patch.

14. A dual-band microstrip antenna as in claim 13, wherein a coaxial cable is attached to the antenna such that a ground portion of the cable is connected to the cross-piece of the ground member, and such that a signal feed portion of the cable defines the antenna signal feedline attached to the first patch.

15. A dual-band microstrip antenna as in claim 13, wherein the antenna is formed from a printed circuit board having a conductive layer on one side, wherein the conduction surfaces of the ground member are formed by removing portions of the conductive layer on the one side of a first segment of the circuit board, wherein the conduction surfaces of the patch structure are formed by removing portions of the conductive layer on the one side of a second segment of the circuit board, wherein the first and second segments of the circuit board are then mounted in parallel spaced relationship, and wherein shorting members are applied between the ground member and the second patches proximate the one end of the ground member and the one end of the second patches.

16. A dual-band microstrip antenna comprising:

a ground member having a generally rectangular profile; and a patch structure extending in a plane in generally parallel spaced relationship with a plane in which the ground member extends, the patch structure comprising:

a first patch without connection to the ground member but connectable to an antenna signal feedline; and a pair of second patches each having an inner edge positioned adjacent a respective outer edge of the first patch, an outer edge of each second patch being generally aligned with a respective side edge of the ground member, one end of each second patch being connected to and generally aligned with one end of the ground member;

wherein, when the antenna is active, the first patch exhibits excitation in both first and second resonant frequency ranges resulting from electromagnetic interaction between the first patch and the ground member and between the first patch and the pair of second patches.

17. A dual-band microstrip antenna as in claim 16, wherein conduction surfaces of the patch structure and conduction surfaces of the ground member are shaped to substantially correspond to patterns of current flow detected in the respective patch-structure and ground-member conduction surfaces when the antenna is active before such shaping.

* * * * *